United States Patent [19]

Bergquist et al.

[11] 4,033,532

[45] July 5, 1977

[54] POWER TOOL SUPPORT

[75] Inventors: Arne Erik Bergquist, Stockholm; Sven Peter Jonas Westerberg, Saltsjo-Boo, both of Sweden

[73] Assignee: Atlas Copco Aktiebolag, Nacka, Sweden

[22] Filed: Nov. 17, 1975

[21] Appl. No.: 632,305

[30] Foreign Application Priority Data

Nov. 22, 1974 Sweden ..... 74146804

[52] U.S. Cl. ..... 248/17; 248/324; 254/167; 408/235

[51] Int. Cl.[2] ..... B25B 15/00; B25B 7/00

[58] Field of Search ..... 248/17, 325, 331, 334, 248/328, 329, 330, 324; 254/167; 193/163; 408/235, 236, 237

[56] References Cited

UNITED STATES PATENTS

| | | | |
|---|---|---|---|
| 371,195 | 10/1887 | Henley | 408/325 UX |
| 1,256,073 | 2/1918 | Stevenson | 408/237 X |
| 2,837,307 | 6/1958 | Schinager et al. | 248/325 |
| 2,983,199 | 5/1961 | Daugherty | 408/325 X |
| 3,281,121 | 10/1966 | Ratcliff | 254/167 |
| 3,397,749 | 8/1968 | Haskins et al. | 248/325 X |

FOREIGN PATENTS OR APPLICATIONS

| | | | |
|---|---|---|---|
| 14,122 | 2/1956 | Germany | 408/235 |

*Primary Examiner*—J. Franklin Foss
*Attorney, Agent, or Firm*—Flynn & Frishauf

[57] ABSTRACT

A hand held power tool is connected to a stable reaction point by means of a support device for balancing the reaction torque arising when operating the power tool. The support device comprises two or more links which are articulated relative to each other as well as to the tool and to the reaction point. The articulated link joints comprise pivot pins which are all parallel to each other but perpendicular to the rotation axis of the power tool output shaft. A spring actuated balancing block is connected to the support device for suspending the power tool and that part of the support device that is not suspended in the reaction point.

12 Claims, 6 Drawing Figures

POWER TOOL SUPPORT

BACKGROUND OF THE INVENTION

This invention relates to a power tool support, and more particularly to a support for taking up the torque reaction arising when operating a manually portable power tool.

During use of for instance a hand held power wrench at an assembly line in a factory an operator has to perform daily a great number of nut or screw tightening operations. At each of such operations the operator has to take up the torque reaction from the wrench by muscle power, which means that he is subjected to rather heavy strains.

With most heavy duty power wrenches of the continuous torque type the output torque and accordingly the reaction torque is too high for an operator to manage. Therefore, such heavy duty power wrenches have been provided with reaction torque arms extending from the wrench housing to the work piece for taking support on the latter.

A reaction torque support of this type has to be of such a shape as to be able to engage a protruding part of the work piece and transfer the reaction torque thereto. Such an arrangement is disadvantageous in that the support arm has to be specifically adapted to the actual work piece or to the screw joint location thereon and might not be suitable for obtaining a proper support at another work piece or at another screw joint on the same work piece. So, support arms of different shapes have to be utilized for different screw joints.

The above described arm type reaction support is disadvantageous also in that its engagement with the work piece might accidentally get lost, for instance by slipping, during the tightening process. At such a loss of support the entire tool suddenly starts rotating backwards and the operator might get hurt.

Another application for a reaction torque in portable drilling machines which due to heavy drilling torque or sudden drill jamming may put too heavy a load on the operator.

OBJECTS OF THE INVENTION

It is an object to the invention to provide a novel type of support for taking up the torque reaction from a power tool.

It is a further object of the invention to make a power tool support by which the reaction torque is properly balanced whatever the location of for instance a screw joint or the shape of the work piece may be.

It is a still further object of the invention to make a power tool support by which the operator is safely protected from being subjected to the torque reaction from a power tool.

DETAILED DESCRIPTION

Figure 1:
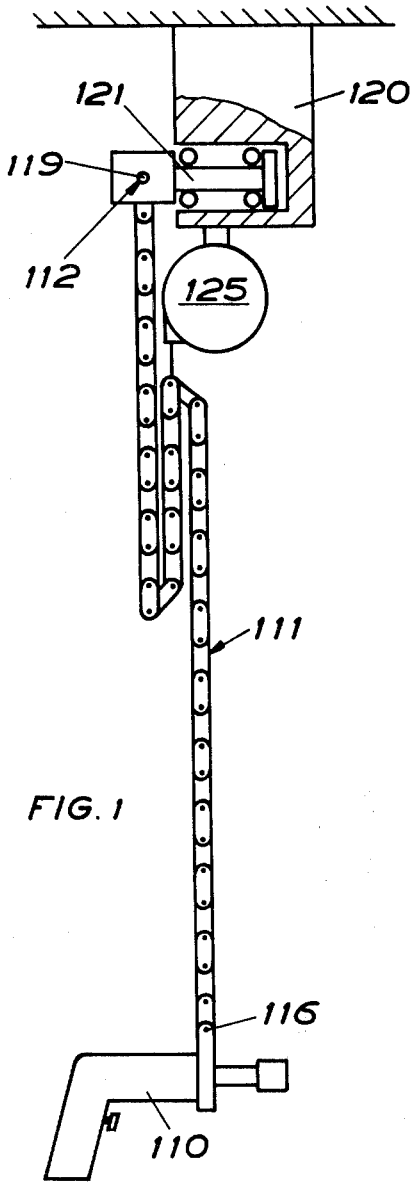
FIG. 1 shows a side view of a pistol type power wrench provided with a reaction support according to one embodiment of the invention.
Figure 2:
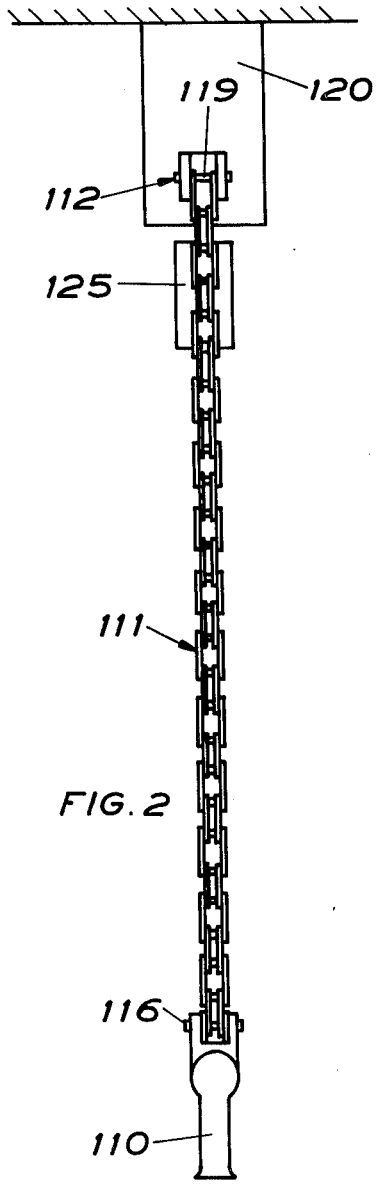
FIG. 2 shows a rear end view of the power wrench and the reaction support shown in FIG. 1.

In FIGS. 1 and 2, 110 designates a pistol type power wrench which by means of an articulated link chain 111 is connected to a stable reaction point 112. The chain 111, which constitutes a reaction torque support for the power wrench 110, is pivotably connected to the power wrench 110 and to the reaction point 112 by means of pivot pins 116 and 119, respectively. The pivot pins 116 and 119 as well as the articulated link connections of the support chain 111 have their rotation axes directed perpendicularly relative to the rotation axis of the power wrench output shaft.

At the reaction point 112 the chain 111 is supported by a horizontal swing axle 121 which is rotatably journalled in a roof mounting 120 and which is formed with a forked end for receiving the pivot pin 119 and the uppermost link of the chain 111.

A spring actuated balancing block 125 is interconnected between the roof mounting 120 and an intermediate link of the chain 111, thereby suspending the chain 111 in Z-form. By pulling the chain, the distance between the power wrench 110 and the reaction point 112 may be increased and the power wrench 110 is free to operate at different levels.

The balancing block 125 also takes up the weight of the power wrench 110 and the weight of that part of the chain 111 that is not suspended by the pivot pin 119 in the reaction point 112. Accordingly, the chain 111 serves to protect the operator from getting subjected to the reaction torque as well as the weight of the power wrench. Though being stiff enough in its one transverse direction for resisting the bending strains resulting from the power wrench reaction torque, the chain 111 is very flexible in its other transverse direction which is advantageous for facilitating handling of the wrench.

Figure 6:
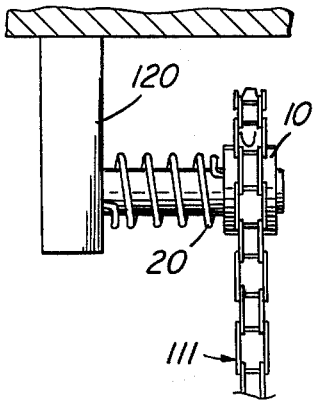
FIG. 6 shows a rear end view of the support of FIG. 5.
Figure 5:
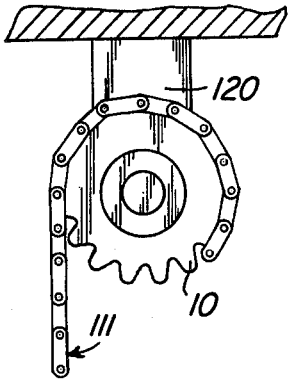
FIG. 5 shows a side view of a modified support.

As shown in FIGS. 5 and 6, instead of utilizing a balancing block according to the above described embodiment of the invention, the chain 111 may be supported by a sprocket wheel 10 which is rotatably journalled to the roof mounting 120 and loaded by a torsion spring 20 in its winding direction.

Figure 3:
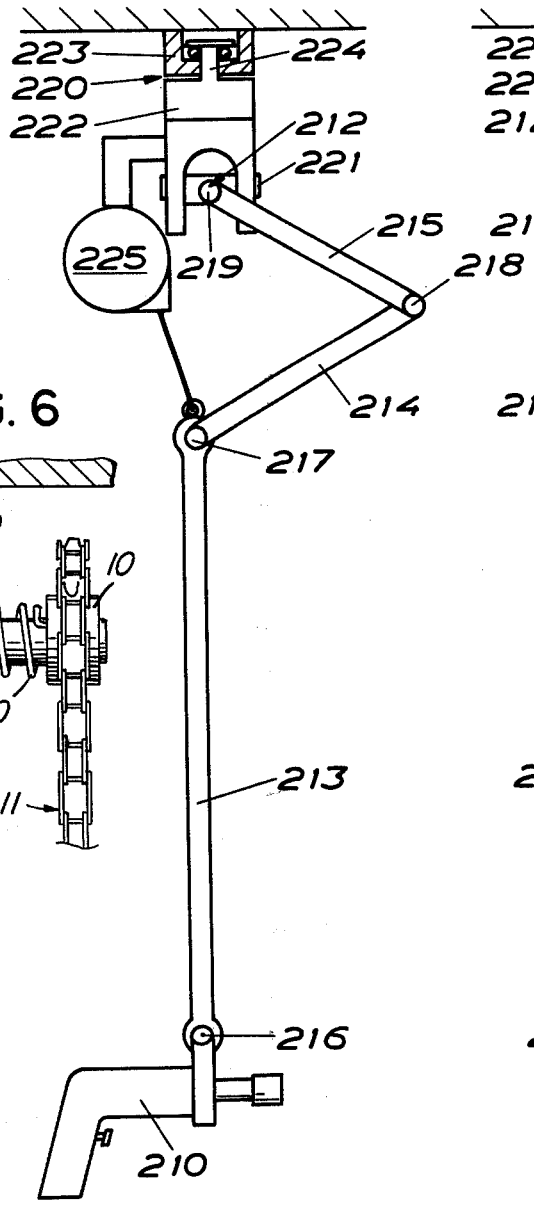
FIG. 3 shows a side view of a pistol type a power wrench provided with a reaction support according to another embodiment of the invention.
Figure 4:
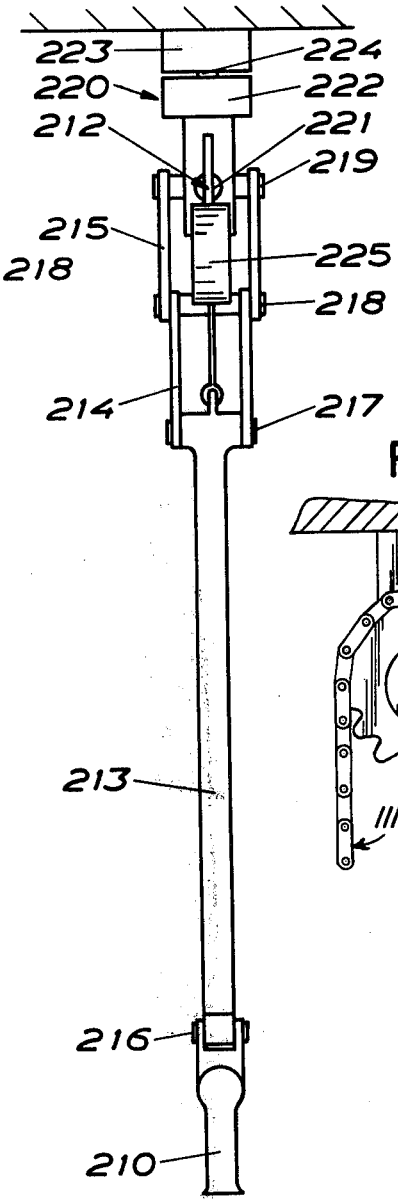
FIG. 4 shows a rear end view of the power wrench and the support shown in FIG. 3.

In FIGS. 3 and 4 there is shown an alternative design of a reaction support according to the invention. In this embodiment the number of links has been reduced so as to comprise three links only.

A pistol type power wrench 210 is connected to a stable reaction point 212 via two shorter links 215, 214 and one longer link 213, which links are articulated relative to one another by means of joints comprising pivot pins 217 and 218. The links are connected to the power wrench and to the reaction point by means of pivot pins 216 and 219, respectively. The rotation axes of all of these pivot pins are parallel to each other but perpendicular to the rotation axis of the power wrench output shaft. By this arrangement the power wrench 210 is free to be moved forwards, and backwards, up and down and to be tilted in a vertical plane.

For making the power wrench 210 movable in a sidewise direction the reaction point 212 comprises a second pivot pin 221 perpendicular to the pivot pin 219. These pivot pins constitute a universal joint.

The pivot pin 221 of the universal joint is rotatably jounalled in a roof mounting 220. The roof mounting comprises a lower part 222 and an upper part 223, which parts are intercoupled by means of a swivel joint 224 having a vertical rotation axis. The employment of the swivel joint 224 means that the power wrench 210 is able to operate in different angular directions.

In order to relieve the operator from the weight of the power wrench and the support links, the upper end of link 213 is connected to the wire of a spring type balancing device 225. The latter is attached to the lower part 222 of the roof mounting 220.

The power tool support according to this invention is not limited to the shown and described embodiments but can be freely varied within the scope of the invention as it is defined by the claims.

For instance the number of links could be varied within wide limits from the simplest alternative comprising two links to a chain formed of a great number of links.

What we claim is:

1. A reaction support for balancing the reaction torque of a power tool, said power tool having a rotating output shaft, comprising:

a stable reaction point, a chain of a plurality of links, substantially greater than three in number, which are pivotably connected to each other, and means for pivotally connecting said link chain to the power tool and to the reaction point with a plurality of chain links interposed between said power tool and said reaction point, all of said pivotable connections providing pivoting axes which are parallel to each other but perpendicular to the rotation axis of the power tool output shaft, said chain being stiff in a transverse direction thereof to resist bending strains resulting from the power wrench reaction torque.

2. A reaction support for balancing the reaction torque of a power tool, said power tool having a rotating output shaft, comprising:

a stable reaction point located above the power tool in the normal operating position of the power tool, a chain of a plurality of links, substantially greater than three in number, which are pivotably connected to each other, means for pivotally connecting said link chain to the power tool and to the reaction point with a plurality of chain links interposed between said power tool and said reaction point.

all of said pivotable connections providing pivoting axes which are parallel to each other but perpendicular to the rotation axis of the power tool output shaft, said chain being stiff in a transverse direction thereof to resist bending strains resulting from the power wrench reaction torque, and a spring means coupled to at least one of said links of said chain which are disposed at an intermediary point of said chain for balancing the weight of the power tool as well as the weight of the links disposed between said at least one intermediary link and the power tool.

3. A reaction support for balancing the reaction torque of a power tool, said power tool having a rotating output shaft, comprising:

a reaction point located above the power tool in the normal operating position of the power tool, a chain of a plurality of links, substantially greater than three in number, which are pivotably connected to each other, means for pivotably connecting said link chain to the power tool and to the reaction point with a plurality of chain links interposed between said power tool and said reaction point, all of said pivotable connections providing pivoting about axes which are parallel to each other but perpendicular to the rotation axis of the power tool output shaft, said chain being stiff in a transverse direction thereof to resist being strains resulting from the power wrench reaction torque, and a sprocket wheel which is rotatably journalled in the reaction point and which is loaded by a torsion spring in its winding direction, said sprocket wheel engaging links of said chain and enabling extension or retraction of said chain.

4. A reaction support according to claim 1 wherein said stable reaction point comprises a universal joint.

5. A reaction support according to claim 4 wherein said reaction point further comprises a swivel joint having a vertical rotation axis.

6. A reaction support according to claim 1 wherein said reaction point comprises a swivel joint having a vertical rotation axis.

7. A reaction support according to claim 2 wherein said stable reaction point comprises a universal joint.

8. A reaction support according to claim 7 wherein said reaction point further comprises a swivel joint having a vertical rotation axis.

9. A reaction support according to claim 2 wherein said reaction point comprises a swivel joint having a vertical rotation axis.

10. A reaction support according to claim 3 wherein said stable reaction point comprises a universal joint.

11. A reaction support according to claim 10 wherein said reaction point further comprises a swivel joint having a vertical rotation axis.

12. A reaction support according to claim 3 wherein said reaction point comprises a swivel joint having a vertical rotation axis.

* * * * *